US005407493A

United States Patent [19]

Yamauchi et al.

[11] Patent Number: 5,407,493

[45] Date of Patent: * Apr. 18, 1995

[54] STAINLESS STEEL SHEET AND METHOD FOR PRODUCING THEREOF

[75] Inventors: Katsuhisa Yamauchi; Hitoshi Misao; Tadashi Inoue; Tomoyoshi Okita, all of Kawasaki, Japan

[73] Assignee: NKK Corporation, Tokyo, Japan

[ * ] Notice: The portion of the term of this patent subsequent to May 24, 2011 has been disclaimed.

[21] Appl. No.: 189,504

[22] Filed: Jan. 31, 1994

Related U.S. Application Data

[63] Continuation-in-part of Ser. No. 99,171, Jul. 29, 1993, Pat. No. 5,314,549.

[30] Foreign Application Priority Data

| | | | |
|---|---|---|---|
| Mar. 8, 1993 | [JP] | Japan | 5-072901 |
| Nov. 30, 1993 | [JP] | Japan | 5-326172 |
| Nov. 30, 1993 | [JP] | Japan | 5-326173 |

[51] Int. Cl.[6] ..... C22C 38/10; C22C 38/40; C21D 8/02

[52] U.S. Cl. ..... 148/325; 148/327; 148/610

[58] Field of Search ..... 148/325, 327, 610

[56] References Cited

U.S. PATENT DOCUMENTS

| | | | |
|---|---|---|---|
| 3,660,173 | 5/1972 | Matsuno et al. | 148/325 |
| 4,849,166 | 7/1989 | Hoshino et al. . | |
| 4,963,200 | 10/1990 | Okuda et al. | 148/325 |
| 5,167,731 | 12/1992 | Minami et al. | 148/325 |
| 5,232,520 | 8/1993 | Oka et al. | 148/325 |

FOREIGN PATENT DOCUMENTS

| | | |
|---|---|---|
| 51-32569 | 9/1976 | Japan . |
| 54-52614 | 4/1979 | Japan . |
| 61-295356 | 12/1986 | Japan . |
| 63-317628 | 12/1988 | Japan . |
| 2-44891 | 10/1990 | Japan . |

*Primary Examiner*—Deborah Yee

*Attorney, Agent, or Firm*—Frishauf, Holtz, Goodman & Woodward

[57] ABSTRACT

A fracture resistant stainless steel sheet comprises: non-metallic inclusions of $Al_2O_3$, MnO, and $SiO_2$ which inevitably exist in stainless steel; the non-metallic inclusions having a composition situated in a region defined by nine points in a phase diagram of a 3-component system of "$Al_2O_3$-MnO-$SiO_2$"; the stainless steel sheet having an 1.0% on-set stress of at least 1520 N/mm$^2$ (155 kgf/mm$^2$); the stainless steel sheet having an anisotropic difference of 1.0% on-set stress of 196 N/mm$^2$ (20 kgf/mm$^2$) or less; and the stainless steel sheet having a punch test work load of at least 25 kgf·mm or more.

A method for producing a high fracture resistant stainless steel sheet comprises the steps of: preparing a stainless steel strip; applying to the stainless steel strip a process of annealing—pickling —first cold rolling ($CR_1$)—first intermediate annealing—second cold rolling ($CR_2$)—second intermediate annealing—third cold rolling ($CR_3$)—final annealing—fourth cold rolling ($CR_4$)—low temperature heat treatment.

18 Claims, 4 Drawing Sheets

STAINLESS STEEL SHEET AND METHOD FOR PRODUCING THEREOF

CROSS REFERENCE TO RELATED APPLICATION

This is a continuation-in-part-application of Ser. No. 08/099,171 filed on Jul. 29, 1993, which issued as U.S. Pat. No. 5,314,549 which is incorporated herein in its entirely reference.

BACKGROUND OF THE INVENTION

The present invention relates to a fracture resistant stainless steel sheet and method for producing thereof, and particularly to a stainless steel sheet used as a substrate of inner diameter saw blades which are used to slice an ingot of silicon, for example, into wafers and method for producing thereof.

DESCRIPTION OF THE RELATED ARTS

Hitherto, as a base material for inner diameter saw blade substrate, metastable austenitic stainless steel and precipitation hardening (PH) stainless steel have mainly been applied.

The metastable austenitic stainless steels typically represented by SUS 301 and SUS 304 obtain high strength by work-hardening through the cold working after annealing and by forming work-induced martensitic phase and further by aging. JP-B-2-44891 (the trem "JP-B-" referred to herein signifies "examined Japanese Patent publication") disclosed a technology on this type of steel. According to the disclosure, a steel sheet containing a controlled composition to give a desired degree of austenitic phase stability is subjected to the temper rolling at the reduction ratio of 40% or more and first and second cold-rollings before finish cold-rolling where the ratio of the first cold-rolling to the second cold-rolling is 0.8 or more. This process aims at improving the flatness of the steel during tensioning by obtaining a tensile strength of 130 kgf/ $mm^2$ or more and the minimized plane anisotropy of strength (0.2% proof stress).

A typical example of the precipitation hardening stainless steel is SUS 631. By cold working or sub-zero treatment of the steel after annealing, martensitic structure or dual phase structure of austenite and martensite develops. In the successive aging-treatment, the precipitation hardening proceeds to give a high strength thereto. Such types of steel were introduced in JP-A-61-295356 and JP-A-63-317628, (the term "JP-A" referred to herein signifies "unexamined Japanese Patent publication"). According to these patents, the precipitation hardening proceeds by adding Si and Cu to obtain a high hardness, Hv=580. Moreover, high cracking stress is achieved and tensioning property is improved.

The inner diameter saw blades are necessary to secure the flatness thereof for improving the surface quality of sliced wafers and for minimizing the cutting loss of ingot. Furthermore, the true circularity of the inner diameter saw blade is necessary for suppressing local stress intensity on the blade to minimize the blade fracture during slicing. For further improvement of the rigidity of the inner diameter saw blade, the blade is applied with tension in the circumferential direction, (herein after referred to simply as "tensioning"), during slicing. In particular, the reduction of vibration of blade by increasing the rigidity of the blade to reduce the cutting loss of ingot has become an essential measures to improve the production yield. Consequently, it is requested to give an extremely high rigidity to the blade by applying a high strain of approximately 1.0% in circumferential direction during the tensioning stage.

Blades of conventional stainless steels have, however, disadvantages that they often fracture before obtaining sufficient tensioning and that, even the blades having a good tensioning property, they fracture during slicing operation.

In JP-B-2-44891, the plane anisotropy of strength was considered but the fracture characteristic was not respected at all. In JP-A-61-295356 and JP-A-63-317628, strength before tensioning was improved to some extent, but the fracture during slicing after the tensioning was not considered at all. Both technologies gave no improvement on the fracture resistance under a high strain as large as approximately 1.0% during tensioning. In fact, the stainless steel sheets employed in above described three prior arts show a high tensile strength but give a low deformation stress when applied with the strain of 1.0%, (hereinafter referred to simply as "1.0% on-set stress"), or give a low toughness. Consequently, the inner diameter saw blades which employ these materials often fracture during tensioning, and, even they have a good tensioning property, they fracture during slicing operation.

SUMMARY OF THE INVENTION

The object of the present invention is to provide a stainless steel sheet having high fracture: resistance and a method for producing thereof.

To achieve the object, the present invention provides a high fracture resistant stainless steel sheet comprising: non-metallic inclusions of $Al_2O_3$, MnO, and $SiO_2$ which inevitably exist in stainless steel;

the nonmetallic inclusions having a composition situated in a region defined by nine points given below on terms of percentage by weight in a phase diagram of a 3-component system of "$Al_2O_3$-MnO-$SiO_2$", Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

said stainless steel sheet having an 1.0% on-set stress of 155 kgf/$mm^2$ or more, where the 1.0% on-set stress is a deformation stress when the sheet is subjected to 1.0% strain;

said stainless steel sheet having an anisotropic difference of 1.0% on-set of 196 N/$mm^2$ (20 kgf/$mm^2$) or less, where the anisotropic difference is an absolute value of a difference of 1.0% on-set stresses in a rolling direction and a crosswise direction to the rolling direction;

said stainless steel sheet having a punch test work load of at least 0.24 J (25 kgf·mm).

Furthermore, the present invention provides a method for producing a high fracture resistant stainless steel sheet comprising the steps of:

praparing a stainless steel strip consisting essentially of 0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % solution Al, 0.002 to 0.013 wt. % O, 0.08 to 0.9 wt. % Cu, 0.009 wt. % or less S, and the balance being Fe and inevitable impurities;

said inevitable impurities existing as non-metallic inclusions having a composition situated in a region defined by nine points given below on terms of percentage by weight in a phase diagram of a 3-component system of "$Al_2O_3$-MnO-$SiO_2$", Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

applying to the stainless steel sheet a process of annealing—pickling—first cold rolling ($CR_1$)—first intermediate annealing—second cold rolling ($CR_2$)—second intermediate annealing—third cold rolling ($CR_3$)—final annealing—fourth cold rolling ($CR_4$)—low temperature heat treatment;

reduction ratios of said first cold rolling, of said second cold rolling, and of said third cold rolling, each being 30% to 60%;

a reduction ratio of said fourth cold rolling being 60 to 76%, and a reduction ratio per pass of the fourth cold rolling being 3 to 15%;

annealing temperatures in said first annealing, second annealing and final annealing, each being 950° to 1100° C., respectively;

said low temperature heat treatment being performed at a temperature of 300° to 600° C. for 0.1 sec to 300 sec.;

said final annealing and said low temperature heat treatment being performed in a non-oxidizing atmosphere containing $H_2$ of 70 vol. % or more.

DESCRIPTION OF THE PREFERRED EMBODIMENT

Figure 1:
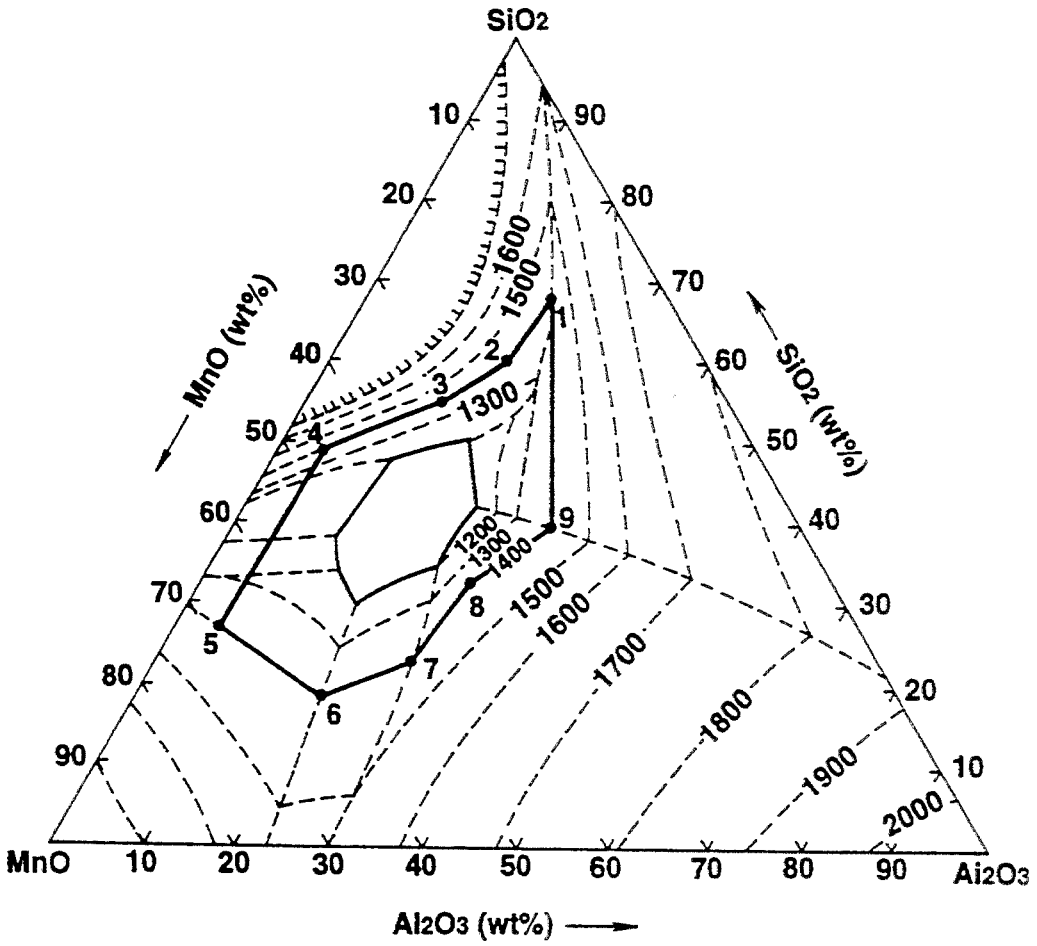
FIG. 1 is a diagram showing a region of a composition of inclusion of the present invention in the phase diagram of a 3-component system of "$Al_2O_3$-MnO-$SiO_2$"

The inventors performed a series of extensive study on the optimization of mechanical properties such as the Young's modulus, the deformation stress under a strain of approximately 1.0%, the plane anisotropic difference, and the toughness, and the composition and manufacturing conditions to obtain these mechanical properties, and the inventors found that the following knowledge on the stainless steel sheets which show high fracture resistance with a good tensioning property and high fracture resistance under the tensioning stage and slicing stage.

(1) For the improvement of fracture resistance during the tensioning of a blade and during slicing stage, the reduction of both thickness and quantity of the non-metallic inclusions which tend to become an origin of fracture, and the introduction of inclusions having a high ductility are effective means. To do so, it is necessary that the composition of non-metallic inclusions inevitably existing in the steel includes $Al_2O_3$, MnO, and $SiO_2$, and that those inclusions are situated in a region encircled by nine points (1 through 9) given in a phase diagram of a 3-component system of "$Al_2O_3$-MnO-$SiO_2$.

(2) In order to improve the fracture resistance during tensioning, the optimization of Young's modulus which governs the toughness and tensioning and the control of non-metallic inclusions which were described in (1) are required. In other words, the punch test work load (work load for plastic deformation in a punch test) of 0.24 J (25 kgf·mm) or more is required, and the Young's modulus is preferably at 166,600 N/mm$^2$ (17,000 kgf/mm$^2$) or more.

(3) For the improvement of fracture resistance during slicing operation with a blade, the optimization of a balance of 1.0% on-set stress, plane anisotropy of 1.0% on-set stress, and toughness is required along with the control of non-metallic inclusions which was described in (1). In other words, it is necessary that the 1.0% on-set stress is 1520 N/mm$^2$ (155 kgf/mm$^2$) or more and that the anisotropic difference of 1.0% on-set stress (the absolute value of the difference between the 1.0% on-set stresses in the rolling direction and in the direction lateral to the rolling) of 196 N/mm$^2$(20 kgf/mm$^2$) or less and that the punch test work is 0.24 J (25 kgf·mm) or more.

(4) In the case that a stainless steel sheet having the material characteristics described above made from a metastable austenitic stainless steel, it is necessary to control the non-metallic inclusions described in (1) and to optimize the quantity of martensite under a specified composition and to minimize and uniform the effective grain size. In concrete terms, the inner diameter saw blade made from the stainless steel sheet should include the content of martensite of 40 to 90%, wherein the stainless steel strip consisting essentially of the composition described above is subjected to the manufacturing process including annealing, pickling, first cold-rolling, intermediate annealing, second cold-rolling, intermediate annealing, third cold-rolling, final annealing, fourth cold rolling, and low temperature heat treatment. In this process, the following condition should be satisfied. The reduction ratios of the first, second and third cold-rolling, each are 30 to 60%; the reduction ratio of the fourth cold-rolling (temper rolling) is 60 to 76% and the reduction ratio per pass (the reduction ratio of the fourth cold-rolling divided by the number of passes) is 3.0 to 15%; the final annealing and the low temperature heat treatment are performed in a non-oxidizing atmosphere containing 70 vol % or more of $H_2$; the intermediate and the final annealing are performed in a temperature range of 950° to 1150° C.; and the aging is performed for 1 to 300 sec.

The following is the detailed description of the present invention along with the reason of limiting individual conditions.

The base materials for inner diameter saw blade substrates are necessary to be made of stainless steel because they should have a sufficient corrosion resistance during the slicing of, for example, Si ingot. Since the base material for inner diameter saw blade substrates is a very thin sheet (normally 0.3 mm or less in thickness), it is effective to reduce the thickness and quantity of non-metallic inclusions which tend to become the origin of fracture and to make these inclusions have a high ductile property for improving the fracture resistance. In concrete terms, it is necessary that the composition of the inevitable non-metallic inclusions containing $Al_2O_3$, MnO, and $SiO_2$, which are included in the range enclosed with lines connecting the following nine points given on terms of percentage by weight in the phase diagram of a 3-component system of "$Al_2O_3$-MnO-$SiO_2$" in FIG. 1, Point 1 ($Al_2O_3$: 21 wt. %, MnO: 12 wt. %, $SiO_2$: 67 wt. %), Point 2 ($Al_2O_3$: 19 wt. %, MnO: 21 wt. %, $SiO_2$: 60 wt. %), Point 3 ($Al_2O_3$: 15 wt. %, MnO: 30 wt. %, $SiO_2$: 55 wt. %), Point 4 ($Al_2O_3$: 5 wt. %, MnO: 46 wt. %, $SiO_2$: 49 wt. %), Point 5 ($Al_2O_3$: 5 wt. %, MnO: 68 wt. %, $SiO_2$: 27 wt. %), Point 6 ($Al_2O_3$: 20 wt. %, MnO: 61 wt. %, $SiO_2$: 19 wt. %), Point 7 ($Al_2O_3$: 27.5 wt. %, MnO: 50 wt. %, $SiO_2$: 22.5 wt. %), Point 8 ($Al_2O_3$: 30 wt. %, MnO: 38 wt. %, $SiO_2$: 32 wt. %), Point 9 ($Al_2O_3$: 33 wt. %, MnO: 27 wt. %, $SiO_2$: 40 wt.).

By limiting the composition ratio among $Al_2O_3$, MnO, and $SiO_2$ in the non-metallic inclusions within the specified range, the fracture resistance is improved.

To obtain the composition of inclusions specified above, it is preferred that a ladle made from MgO-CaO, containing 50% or less CaO and the slag of CaO-$SiO_2$-$Al_2O_3$ containing $[CaO]/[SiO_2] = 1.0$ to 4.0, 3% or less $Al_2O_3$, 15% or less MgO, and 30 to 80% CaO are used in the ladle refining after the tapping.

The inventors found that, for a stainless steel sheet used as an inner diameter blade, the Young's modulus, the 1.0% on-set stress, and the punch test work load are the critical factors on the fracture resistance.

Figure 2:
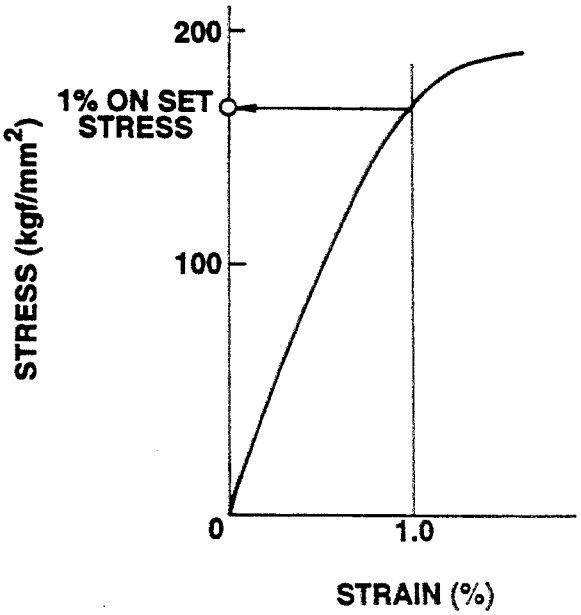
FIG. 2 is a graph showing a procedure for determination of 1.0% on-set stress.

FIG. 2 illustrates the determination procedure of 1.0% on-set stress. In the stress-strain diagram, the deformation stress to the 1.0% strain is called the 1.0% on-set stress. As described above, an inner diameter saw blade is subjected to a high tension corresponding to the magnitude of 1.0% strain in the circumferential direction under the tensioning condition as well as the load of ingot slicing. Consequently, the evaluation of 1.0% on-set stress is effective for determining the fracture resistance.

Figure 3:
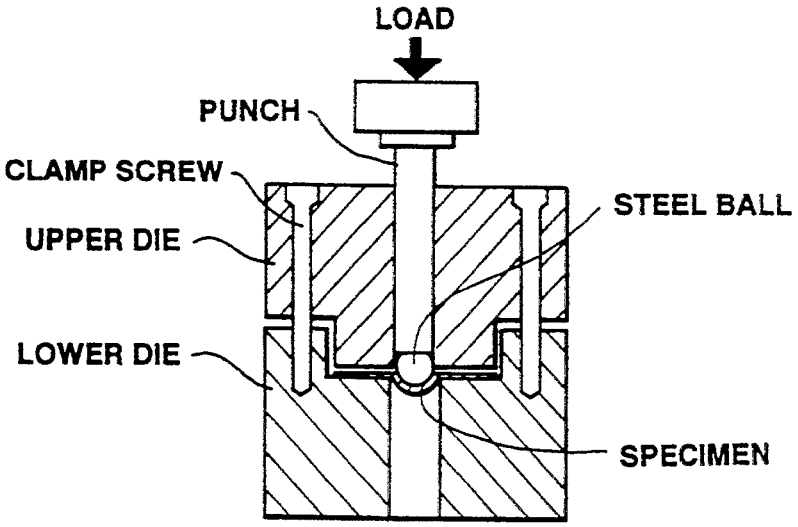
FIG. 3 is a figure showing a general assembly of a miniature punch test device.
Figure 4:
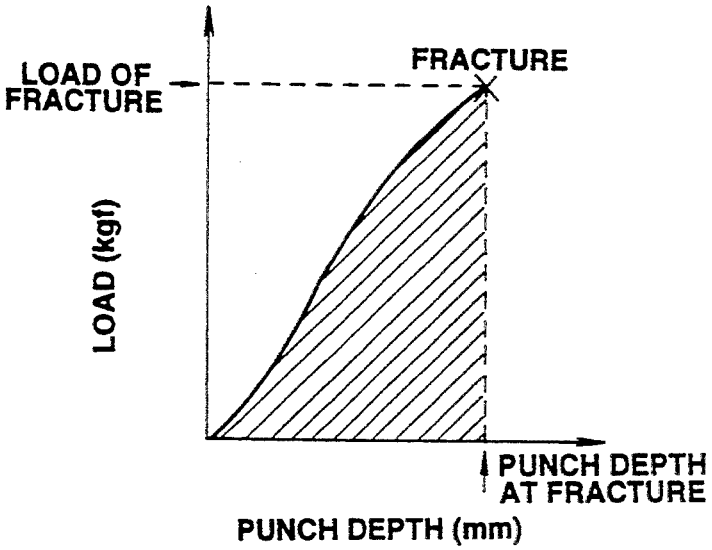
FIG. 4 is a figure showing a procedure to determine the punch test work.

FIG. 3 illustrates the determination procedure of punch test work. In the procedure, a specimen of thin sheet having the size of 10 mm square is attached to the jig as shown in the figure, and a bulge test is conducted by loading a steel sphere of 2.4 mm diameter onto the specimen using Instron type testing machine. From the obtained load-deformation curve which is shown in FIG. 4, the product of the punch load applied to the specimen until it fractures and the punch depth (slashed area in the figure) is obtained, which is employed as an index of work load for plastic deformation and is called the punch test work. The punch test work load is proved to be effective for evaluating the fracture resistance along with the 1.0% on-set stress.

Figure 5:
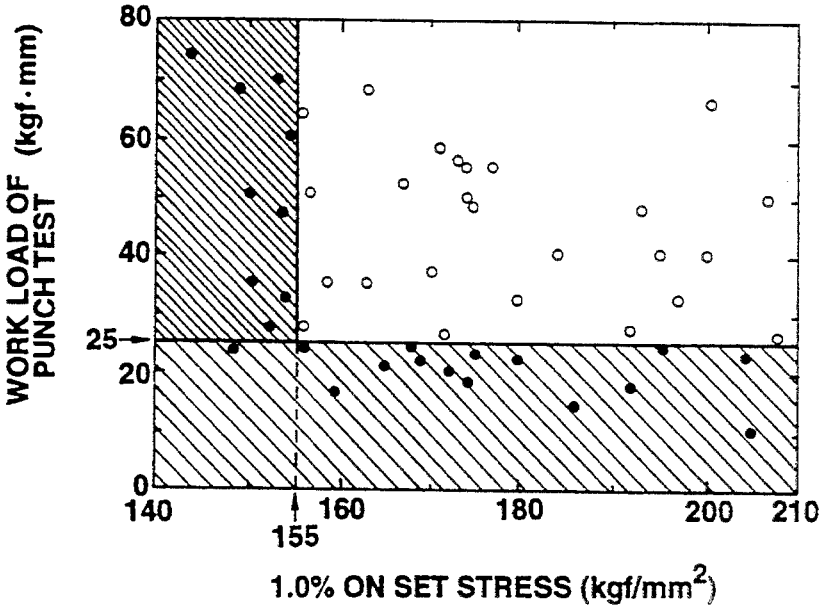
FIG. 5 is a figure showing a effect of the 1.0% on-set stress and the punch test work on the fracture characteristics of the present invention under the condition of the anisotropic difference of 1.0% on-set stress of over 196 N/mm$^2$ (20 kgf/mm$^2$)
Figure 6:
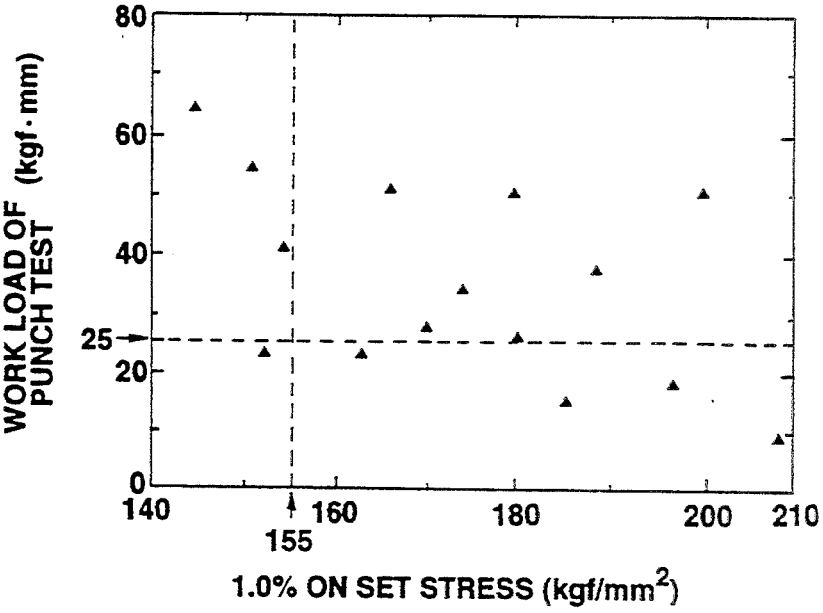
FIG. 6 is a figure showing a effect of the 1.0% on-set stress and the punch test work on the fracture characteristics of the present invention under the condition of the anisotropic difference of 1.0% on-set stress of more than 196 N/mm$^2$ (20 kgf/mm$^2$)

FIG. 5 and FIG. 6 show the effect of 1.0% on-set stress and of punch test work on the fracture resistance. FIG. 5 shows those for the anisotropic difference of 1.0% on-set stress of 196 N/mm$^2$ (20 kgf/mm$^2$) or less, and FIG. 6 shows those for the anisotropic difference of 1.0% on-set stress of above 196 N/mm$^2$ (20 kgf/ mm$^2$). Both figures give only the materials having Young's modulus of 166,600 N/mm$^2$ (17,000 kgf/mm$^2$) or more and giving a good tensioning. Young's modulus varies the magnitude of tension applied to the blade owing to the tensioning, and the Young's modulus of 166,600 N/mm$^2$ (17,000 kgf/mm$^2$) or more is necessary to obtain a good tensioning property. If the Young's modulus is less than 17,000 kgf/mm$^2$, then the tensioning requires significantly increase of the tension applied to the blade, which may degrades the fracture resistance.

According to FIG. 5, within a range of punch test work load of less than 25 kgf·mm, the material fractured during tensioning. On the other hand, in a range of the punch test work load of 0.24 J (25 kgf·mm) or more and the 1.0% on-set stress of less than 1520 N/mm$^2$ (155 kgf/mm$^2$), fracture occurred during slicing. Within a range of the punch test work load of 0.24 J (25 kgf·mm) or more and the 1.0% on-set stress of 1520 N/mm$^2$ (155 kgf/mm$^2$) or more, the material did not fracture during tensioning nor during slicing.

All the materials having the anisotropic difference of 1.0% on-set stress of larger than 196 N/mm$^2$ (20 kgf/mm$^2$) were fractured, which is shown in FIG. 6. Larger anisotropic difference increases the difference of tension in the circumferential direction by tensioning. As a result, significant non-uniformity of tension is induced in the blade plane to generate fracture during slicing. Therefore, the plane anisotropic difference of strength of a base material is preferably as small as possible. As shown in FIG. 5, when the anisotropic difference of 1.0% on-set stress is maintained at 196 N/mm$^2$ (20 kgf/mm$^2$) or less, an excellent fracture resistance is obtained in the region of specific punch test work and of 1.0% on-set stress.

From the above discussion, the present invention specifies the mechanical properties, which are necessary to prevent the base material from fracturing during tensioning or during slicing, as the 1.0% on-set stress of 1520 N/mm$^2$ (155 kgf/mm$^2$) or more, the anisotropic difference of 1.0% on-set stress of 196 N/mm$^2$ (20 kgf/mm$^2$) or less, the punch test work load of 0.24 J (25 kgf·mm) or more. Although the condition of the punch test work load of 0.24 J (25 kgf·mm)or more gives a good tensioning, the punch test work load of 0.34 J (35 kgf·mm) or more is preferred for further improvement of the fracture resistance from the viewpoint of performing several thousand times of slicing of ingot.

Metastable austenitic stainless steel is one of the stainless steels used as the base material of stainless steel sheet for inner diameter blade substrate described above. The following is the description of the condition of composition and of production for the metastable austenitic stainless steel processing and reason thereof.

The individual components are specified for their content.

Carbon is an element to form austenitic phase and contributes to the suppression of δ-ferrite formation and to the strengthening of solid solution of martensitic phase. However, the C concentration of less than 0.01 wt. % does not give a sufficient effect, and the C excess of 0.20 wt. % induces the deposition of Cr carbide to degrade the corrosion resistance and toughness. Consequently, the C content is specified as 0.01 to 0.20 wt. %.

Manganese is also an element to form austenitic phase. The Mn content of 0.1 wt % or more is required for forming austenitic single phase through the solution heat treatment and for deoxidizing. However, when the content of Mn exceeds 2.0 wt. %, the austenitic phase becomes excessively stable, which extremely suppresses the formation of martensitic phase. Consequently, the range of Mn content is specified as 0.1 to 2.0 wt. %.

Nickel is an element for forming strong austenitic phase. When the content of Ni is less than 4.0 wt. %, single-phase austenite does not develop after annealing. On the other hand, when the content of Ni is more than 11 wt. %, austenitic phase becomes excessively stable, which extremely suppresses the formation of martensitic phase. Therefore, the range of Ni content is specified as 4.0 to 11.0 wt. %.

Chromium is an indispensable element for stainless steels, and the Cr content of 13.0 wt. % or more is necessary to give a sufficient corrosion resistance. However, Cr content of 20.0 wt. % or more induces a large amount of δ-ferritic phase at a high temperature, which degrades the hot workability. Accordingly, the range of Cr content is specified as 13.0 to 20.0 wt. %.

Nitrogen is an austenitic phase forming element and also contributes to the strengthening of solid solution of martensitic phase. The N content less than 0.01 wt. % does not give the effect, and the content of more than 0.20 wt. % causes the generation of blow hole during casting. Consequently, the range of N content is specified as 0.01 to 0.20 wt. %.

Aluminum (Soluble Al) content determines number and composition of non-metallic inclusions. When Sol.Al content is less than 0.0005 wt. %, the oxygen content of molten steel exceeds 0.013 wt. % so that inclusions having high content of MnO and $SiO_2$ and inclusions having high boiling point inclusions such as $Cr_2O_3$ develops much to degrade the hot workability of steel and to increase the probability of fracturing of blade. On the other hand, when the Sol.Al content exceeds 0.0025 wt. %, the O content in the molten steel becomes less than 0.002 wt. % and the number of inclusions decreases. However, in the latter case, the inclusions containing a large amount of $Al_2O_3$ appear, which induces surface defects and enhances the fracture of blade. Therefore, in order to have the $Al_2O_3$-MnO-$SiO_2$ system non-metallic inclusions in steel, having a hot ductility with a low melting point as shown in FIG. 1 and further to make the thickness of the inclusions thin and to decrease the number of the inclusions, the content of Sol. Al is necessary to specify in a range of 0.0005 to 0.0025 wt. % and the content of O is specified to a range of 0.002 to 0.013 wt. %.

Copper is an element to strengthen the passive surface layer and to improve corrosion resistance necessary for application as an inner diameter saw blade. Nevertheless, the Cu content of less than 0.08wt. % shows no sufficient effect. The Cu content of more than 0.90wt. %, however, saturates the effect and degrades the hot workability because Cu is not completely occluded in austenitic phase. Consequently, the range of Cu content is specified as 0.08 to 0.90 wt. %.

Silicon is an element contributing to the strengthening the solid solution of austenitic phase and martensitic phase. The Si content of less than 0.1 wt. % does not give sufficient effect, and the Si content of more than 2.0 wt. % forms δ-ferritic phase to degrade the hot workability. Consequently, the range of Si content is specified as 0.1 to 2.0 wt. %.

Sulfur forms inclusions such as MnS. These inclusions tend to become an origin of fracture of blade. In particular, the more than 0.0090 wt. % of S content degrades toughness to increase the possibility of fracture. Consequently, the upper limit of the S content is specified as 0.0090 wt. %.

The metastable austenitic stainless sheets of the present invention can contain appropriately Ca and rare earth metal (REM) aiming to control the shape of sulfides and to improve the hot workability, and also B or other elements aiming at the improvement of hot workability beside the components described above. The addition of these elements does not influence the basic characteristics of this invention.

Figure 7:
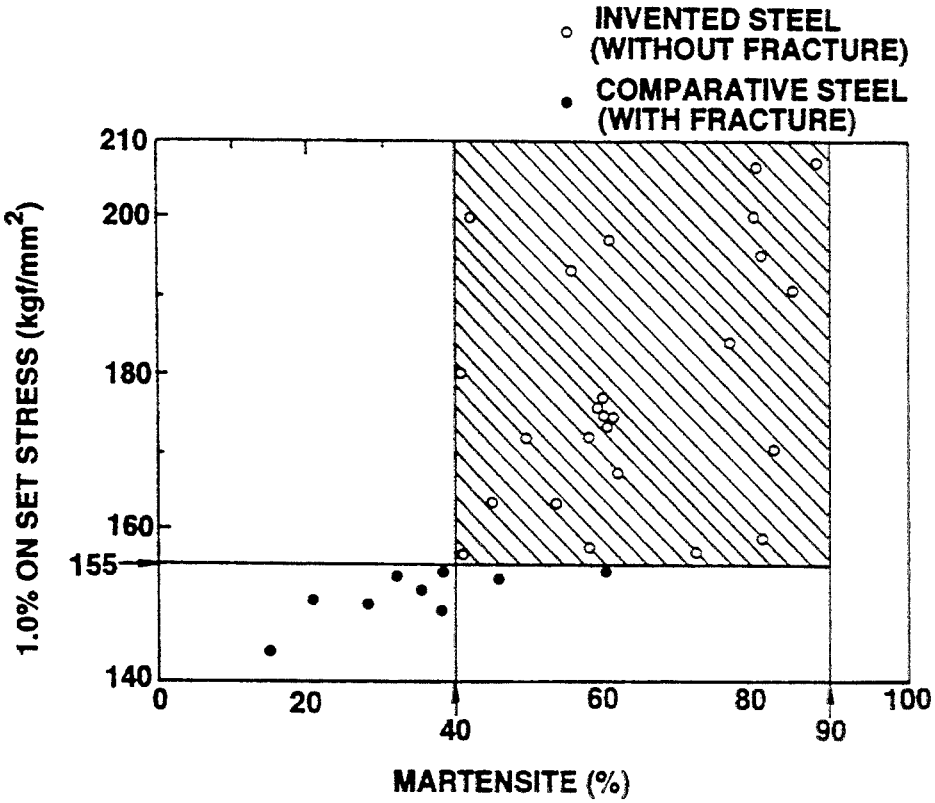
FIG. 7 is a figure showing an effect of the 1.0% on-set stress and the quantity of martensite on the fracture characteristics of the present invention.

The inventors studied in detail on the material factors to increase the 1.0% on-set stress for the case of metastable austenitic stainless steel and found that the optimization of the quantity of martensitic phase under the condition above described is necessary. FIG. 7 shows the effect of 1.0% on-set stress and quantity of martensite on the fracture resistance. The figure shows only the materials which satisfy the proper conditions of anisotropic difference of 1.0% on-set stress, Young's modulus, and the punch test work. According to FIG. 7, the quantity of martensite is necessary to secure 40% or more by optimizing the cold rolling condition and the aging condition to attain the 1.0% on-set stress of 1520 $N/mm^2$ (155 $kgf/mm^2$) or more. On the other hand, when the quantity of martensite exceeds 90%, the punch test work significantly decreases and the probability of fracturing during tensioning period extremely increases. Therefore, the content of martensite at a sheet thickness being applied to an inner diameter saw blade is specified as 40 to 90%. In FIG. 7, the materials which have the quantity of martensite being 40 to 90% and have the 1.0% on-set stress being less than 1520 $N/mm^2$ (155 $kgf/mm^2$) are the comparative materials of No. 19 and No. 22, which are described later.

The following is the description of the manufacturing method of the above-described metastable stainless steel thin sheet. A stainless strip having the chemical composition described above is subjected to a series of treatment as follows.

Annealing and pickling—first cold rolling—intermediate annealing—second cold rolling—intermediate annealing—third cold rolling—final annealing in a non-oxidizing atmosphere containing $H_2$ of 70 vol. % or more fourth cold rolling—low temperature heat treatment in a non-oxidizing atmosphere containing $H_2$ of 70 vol. % or more.

The repeated cold rolling and annealing cycles induce finer recrystallized texture in every annealing and, in some cases, enhances uniform dispersion of very fine carbide particles, through which the martensitic phase after temper rolling (the fourth cold rolling) becomes very fine. As a result, the 1.0% on-set stress and the punch test work are improved and the texture becomes a random type, which in turn makes the anisotropic difference of 1.0% onset stress small. Therefore, the cold-rolling and annealing cycle is preferably repeated for many times. However, excess repetition of the cycle makes the production line complex and saturates the effect. So the number of repetition of the cold rolling and annealing cycle is selected as three followed by the temper rolling (the fourth cold rolling).

The reduction ratio of the first cold-rolling, the second cold rolling and the third cold-rolling of below 30%, respectively, tends to yield an uneven material because of the mixed texture after annealing. When the reduction ratio of those rolling exceeds 60%, the effect for minimizing the grain size is saturated, the texture becomes excessively strong to increase the plane anisotrophy, and the rolling load increases, which degrades operability. Consequently, the first cold rolling, the second cold rolling, and the third cold rolling select the reduction ratio as in a range of 30 to 60%.

The reason why the refining rolling, or the fourth cold rolling, selects the reduction ratio of 60 to 76% is particularly to improve the 1.0% on-set stress using the quantity of martensite as in a range of 40 to 90 wt. %. When the reduction ratio is below 60%, the quantity of martensite becomes less than 40% and Young's modulus or 1.0% on-set stress becomes insufficient level. On the other hand, when the reduction ratio exceeds 76%, the quantity of martensite exceeds 90% and Young's modulus and 1.0% on-set stress increase, but the punch test work decreases, which can not lead to a strong balance between strength and toughness.

With the reduction ratio per pass during the temper rolling (the reduction ratio determined by dividing the reduction ratio of refining rolling by the number of passes) of less than 3.0%, the punch test work decreases and the operation cost increases due to the increase in the number of rollings. When the reduction ratio exceeds 15%, the anisotropic difference of 0.1% on-set stress increases and the punch test work decreases owing to the non-uniformity of the material. Therefore, the reduction ratio per pass during the refining rolling is specified as 3.0 to 15%.

The low temperature heat treatment is performed to improve the 1.0% on-set stress and other characteristics. The low temperature heat treatment at 300° C. or less gives insufficient effect and does not improve the 1.0% on-set stress. On the other hand, the temperature of low temperature heat treatment at 600° C. or more induces a significant amount of inverse transformation austenitic phase, which degrades the 1.0% on-set stress and other characteristics. Consequently, the temperature of low temperature heat treatment is specified as 300° to 600° C. Regarding the aging time in the specified temperature range, the time shorter than 1 sec. gives insufficient effect and no improvement of 1.0% on-set stress is expected. The time of low temperature heat treatment of more than 300 sec. does not show further improvement of characteristics. In particular, at a temperature region near 600° C., the inverse transformation austenitic phase significantly appears, which degrades the 1.0% on-set stress and other characteristics. Therefore, the time of low temperature heat treatment is specified as 1 to 300 sec. Further improvement of characteristics is expected by performing the low temperature heat treatment in a temperature range of 400° to 500° C. for 2 to 15 sec.

When the final annealing or low temperature heat treatment is performed in an oxidizing atmosphere, the pickling step is required. The pickling generates grain boundary corrosion on the sheet surface, and the corrosion prevents the sheet from obtaining necessary fracture resistance and corrosion resistance. When these heat treatments are carried out in a non-oxidizing atmosphere containing less than 70 vol. % of $H_2$, deposit appears on the sheet surface that prevents steel sheet from obtaining necessary quality of fracture resistance and corrosion resistance. Accordingly, the final annealing and the low temperature heat treatment are to be performed in a non-oxydizing atmosphere containing of 70 vol % or more of $H_2$.

By following the above described conditions, a stainless steel sheet for inner diameter saw blade substrates which has a high strength, an extremely low possibility of fracturing with a stable quality, a small plane anisotropic difference and toughness is produced.

The stainless steel sheets for inner diameter saw blade substrates of the present invention may employ, other than metastable austenitic stainless steel, martensitic PH stainless steel, austenitic PH stainless steel, metastable austenitic PH stainless steel. Also the base steel sheets to produce the stainless steel sheets for inner diameter saw blade substrates of this invention may use cast thin plates and steel sheets prepared from those cast plates.

EXAMPLE

Steels having the composition shown in Table 1 were smelted to form ingots, which were treated by slabbing, then hot rolled to form strips. Steels of A through H are the steels according to the present invention, and steels of I through M are those for comparison. All the steels other than I, J, L, and M were produced using ladle made of MgO-CaO refractory containing CaO of 50% or less during the ladle refining after tapping, and applying the slag having the composition of $CaO-SiO_2-Al_2O_3$ as $[CaO]/[SiO_2] = 1.0$ to 4.0, (weight base), 3% or less $Al_2O_3$, 15% or less MgO, 30 to 80% CaO. With those conditions, the main inclusions appeared were $Al_2O_3$-$MnO-SiO_2$ having the melting point of 1400° C. or less. On the other hand, for the steel K which contains a large amount of S, the inclusions of $Al_2O_3$-$MnO-SiO_2$ gave the melting point of 1400° C. or less but they also included a very large number of sulfides.

Following the manufacturing conditions given in Table 2 and Table 3, each of these hot rolled steel strips was produced to form materials No. 1 through No. 29. Among them, No. 1 through No. 15 are the materials of the present invention, and No. 16 through No. 29 are the comparative materials. Materials No. 1 through No. 15, which were produced from the steels A through H, which are those of the present invention, contained the non-metallic inclusions having low melting point and good hot ductility so that the inclusions were well spread in the rolling direction, and most of the inclusions were in a thin shape as thin as 5 μm or less. Table 4 through Table 6 show the evaluation of quantity of martensite, mechanical properties, and fracture resistance of materials No. 1 through No. 29.

The definition of plane hardness difference, anisotropic difference, punch test work load, and fracture resistance, which are used in Table 4 through Table 6, is given below.

The plane hardness difference is the absolute value of the difference between the maximum hardness and the minimum hardness within a blade plane.

The anisotropic difference is the absolute value of the difference between 1.0% on-set stress in the rolling direction and the crosswise direction to the rolling direction.

The punch test work load is the work load for plastic deformation up to the fracture of a small punch test machine. The work load is the product of the load (kgf) and the punch depth (mm).

The fracture resistance is determined by the slicing test only with the blades which gave a good tensioning property. The blade which experienced no fracture is marked with (O)), and the blade which had a high fracture probability is marked with (X).

Materials No. 1 through No. 15, which are the examples of the present invention, showed the 1.0% on-set stress of 1520 N/ $mm^2$ (155 $kgf/mm^2$) or more, the anisotropic difference of the 1.0% on-set stress of 196 $N/mm^2$ (20 $kgf/mm^2$) or less, the punch test work load of 0.24 J (25 kgf·mm) or more, the Young's modulus of 166,600 $N/mm^2$ (17,000 $kgf/mm^2$) or more. The inner diameter saw blades made from these materials gave good tensioning property without showing fracture both in the tensioning stage and in slicing stage. Those materials of the present invention gave stable material quality and gave very small difference of the hardness within a blade plane between the maximum value and the minimum value. On the other hand, the comparative materials No. 16 thorough No. 29 were inferior in some of the mechanical properties so that the inner diameter saw blades made from those materials resulted in fracture either in the tensioning stage or in the slicing stage.

Among the comparative examples described above, the material No. 16 was poor in the reduction ratio per pass during temper rolling, and the material gave a low punch test work load and tended to fracture during tensioning.

Material No. 17 gave a high reduction ratio during temper rolling, and the material gave a large anisotropic difference of 1.0% on-set stress and it had the tendency of fracturing during tensioning.

Material No. 18 gave a low reduction ratio during temper rolling, and the material gave a small quantity of martensite, which resulted in a poor Young's modulus and poor 1.0% on-set stress, which in turn induced fracture during slicing.

Material No. 19 gave a low reduction ratio during temper rolling, and the material gave a poor 1.0% on-set stress and easily induced fracture during slicing.

Material No. 20 gave a high reduction ratio during temper rolling, and the material was rich in martensite and had a significantly low punch test work load, which resulted in an easy fracturing during tensioning.

Material No. 21 experienced three cycles of cold rolling including the refining rolling, so the anisotropic difference of 1.0% on-set stress became large, and the material was easily fractured during slicing.

Material No. 22 was treated at a low temperature during low temperature heat treatment, so the material experienced insufficient aging. As a result, the material had a poor 1.0% on-set stress and showed easy fracturing during slicing.

Material No. 23 was treated at a high temperature during low temperature heat treatment, so the material yielded a large quantity of inverse transformation austenitic phase, which considerably reduced Young's modulus and 1.0% on-set stress. Also the material had a large anisotropic difference of 1.0% on-set stress, and it easily fractured during tensioning.

Material No. 24 was treated in the atmosphere with a low $H_2$ concentration during the final annealing, so precipitates were developed on the surface, which resulted in a poor punch test work load and easy fracturing during tensioning.

Material No. 25 contained large amount of $Al_2O_3$ and contained large number of inclusions having the thickness of more than 5 μm in thickness and material No. 26 contained large amount of $SiO_2$ and contained large number of inclusions having the thickness of more than 5 μm in thickness. As a result, both materials showed a reduced punch test work load and induced fracture during tensioning.

Material No. 27 contained a lot of inclusions of sulfides, so the material gave a poor punch test work load and induced fracture during tensioning.

Materials No. 28 and No. 29 had a high $SiO_2$ content and inclusions having thickness of more than 5 μm, so they gave poor punch test work load and induced fracture during tensioning.

TABLE 1

(wt %)

| Classification | Steel | C | Si | Mn | P | S | Cr | Ni | N | Sol.Al | O | Cu | Composition of inclusion of $SiO_2$-MnO-$Al_2O_3$ system | | |
|---|---|---|---|---|---|---|---|---|---|---|---|---|---|---|---|
| | | | | | | | | | | | | | $SiO_2$ | MnO | $Al_2O_3$ |
| Example | A | 0.103 | 0.66 | 1.01 | 0.027 | 0.0009 | 16.9 | 6.84 | 0.035 | 0.0009 | 0.0049 | 0.33 | 40 | 39 | 21 |
| | B | 0.032 | 0.48 | 1.13 | 0.032 | 0.0008 | 15.9 | 5.20 | 0.191 | 0.0009 | 0.0035 | 0.30 | 34 | 46 | 20 |
| | C | 0.134 | 1.90 | 0.90 | 0.022 | 0.0016 | 15.9 | 6.05 | 0.034 | 0.0010 | 0.0036 | 0.33 | 47 | 39 | 14 |
| | D | 0.177 | 0.24 | 0.47 | 0.026 | 0.0024 | 16.1 | 6.49 | 0.049 | 0.0011 | 0.0040 | 0.25 | 31 | 50 | 19 |
| | E | 0.109 | 0.57 | 1.82 | 0.023 | 0.0008 | 18.5 | 5.97 | 0.108 | 0.0007 | 0.0057 | 0.30 | 44 | 43 | 13 |
| | F | 0.109 | 0.73 | 0.74 | 0.032 | 0.0020 | 13.8 | 8.82 | 0.013 | 0.0013 | 0.0030 | 0.11 | 39 | 42 | 19 |
| | G | 0.094 | 0.60 | 0.98 | 0.009 | 0.0050 | 16.9 | 6.46 | 0.029 | 0.0024 | 0.0025 | 0.45 | 41 | 28 | 31 |
| | H | 0.095 | 0.71 | 1.00 | 0.014 | 0.0037 | 16.8 | 6.75 | 0.033 | 0.0006 | 0.0124 | 0.22 | 54 | 25 | 21 |
| Comparative example | I | 0.096 | 0.65 | 1.01 | 0.037 | 0.0049 | 16.9 | 6.94 | 0.050 | 0.0032 | 0.0017 | 0.37 | 30 | 20 | 50 |
| | J | 0.106 | 0.65 | 0.96 | 0.026 | 0.0040 | 16.8 | 7.12 | 0.025 | 0.0004 | 0.0134 | 0.35 | 61 | 29 | 10 |
| | K | 0.110 | 0.55 | 0.96 | 0.030 | 0.0094 | 16.8 | 6.88 | 0.062 | 0.0015 | 0.0044 | 0.32 | 44 | 35 | 21 |
| | L | 0.074 | 2.78 | 0.22 | 0.019 | 0.0056 | 14.9 | 5.82 | 0.079 | 0.0013 | 0.0088 | 1.87 | 75 | 12 | 13 |
| | M | 0.069 | 2.96 | 1.03 | 0.031 | 0.0038 | 14.9 | 5.82 | 0.073 | 0.0016 | 0.0078 | 2.05 | 79 | 11 | 10 |

TABLE 2

| Classification | Steel No. | Material No. | Reduction ratio of cold rolling (%) First cold-rolling | Second cold-rolling | Third cold-rolling | Temper rolling (forth) | Temper rolling/pass | Annealing condition Atmosphere/$H_2$ % Intermediate | Final | Annealing temperature (°C.) Intermediate | Final | Heat treatment condition* Atmosphere/$H_2$ % | Temperature (°C.) × time (t) |
|---|---|---|---|---|---|---|---|---|---|---|---|---|---|
| Example | 1 | A | 48 | 38 | 38 | 70 | 7.0 | 99 | 99 | 1000 | 1050 | 99 | 400 × 2 |
| | 2 | A | 38 | 38 | 59 | 62 | 10.3 | 96 | 96 | 1000 | 1050 | 95 | 400 × 2 |
| | 3 | A | 40 | 34 | 39 | 75 | 12.5 | 96 | 96 | 1000 | 1050 | 95 | 400 × 30 |
| | 4 | A | 32 | 32 | 58 | 69 | 6.9 | 75 | 99 | 1000 | 1050 | 99 | 400 × 10 |
| | 5 | A | 44 | 40 | 40 | 70 | 7.0 | 92 | 92 | 1000 | 1050 | 92 | 300 × 300 |
| | 6 | A | 42 | 42 | 41 | 70 | 10.0 | 95 | 95 | 1000 | 1050 | 95 | 400 × 300 |
| | 7 | A | 44 | 40 | 40 | 70 | 10.0 | 90 | 90 | 1025 | 1045 | 90 | 600 × 1 |
| | 8 | B | 38 | 38 | 38 | 75 | 6.8 | 95 | 95 | 960 | 960 | 95 | 400 × 5 |
| | 9 | C | 38 | 38 | 52 | 67 | 13.4 | 95 | 95 | 1080 | 1080 | 95 | 400 × 5 |
| | 10 | D | 38 | 38 | 52 | 67 | 9.6 | 95 | 95 | 1140 | 1140 | 95 | 400 × 5 |
| | 11 | E | 48 | 38 | 38 | 70 | 5.8 | 95 | 95 | 1025 | 1045 | 95 | 400 × 2 |
| | 12 | F | 44 | 40 | 40 | 70 | 8.8 | 90 | 95 | 1025 | 1045 | 95 | 400 × 30 |
| | 13 | G | 44 | 40 | 40 | 70 | 10.0 | 90 | 95 | 1025 | 1045 | 95 | 400 × 30 |
| | 14 | H | 44 | 40 | 40 | 70 | 10.0 | 90 | 95 | 1025 | 1045 | 95 | 400 × 30 |
| | 15 | A | 44 | 40 | 40 | 70 | 3.5 | 99 | 75 | 1025 | 1045 | 75 | 440 × 30 |

*Heat treatment means low temperature heat treatment

TABLE 3

| Classification | Material No. | Steel No. | Reduction ratio of cold rolling (%) First cold-rolling | Second cold-rolling | Third cold-rolling | Temper-rolling (forth) | Temper-rolling/pass | Annealing condition Atmosphere/$H_2$ % Intermediate | Final | Annealing temperature (°C.) Intermediate | Final | Heat treatment condition* Atmosphere/$H_2$ % | Temperature (°C.) × time (t) |
|---|---|---|---|---|---|---|---|---|---|---|---|---|---|
| Comparative example | 16 | A | 44 | 40 | 40 | 70 | 2.9 | 99 | 99 | 1000 | 1025 | 99 | 400 × 2 |
| | 17 | A | 44 | 40 | 40 | 70 | 17.5 | 95 | 95 | 1000 | 1025 | 95 | 400 × 2 |
| | 18 | A | 46 | 46 | 59 | 50 | 7.1 | 92 | 96 | 1000 | 1025 | 96 | 400 × 10 |
| | 19 | A | 44 | 44 | 55 | 57 | 8.1 | 92 | 96 | 1000 | 1025 | 95 | 400 × 10 |
| | 20 | A | 30 | 30 | 32 | 85 | 8.5 | 92 | 96 | 1000 | 1025 | 92 | 400 × 10 |
| | 21 | A | 60 | 50 | — | 70 | 10.0 | 99 | 99 | 1000 | 1025 | 90 | 400 × 2 |
| | 22 | A | 48 | 38 | 38 | 70 | 10.0 | 90 | 96 | 1000 | 1025 | 95 | 250 × 300 |
| | 23 | A | 44 | 40 | 40 | 70 | 10.0 | 90 | 96 | 1000 | 1025 | 95 | 650 × 30 |
| | 24 | A | 44 | 40 | 40 | 70 | 10.0 | 68 | 68 | 1025 | 1045 | 98 | 400 × 30 |
| | 25 | I | 44 | 40 | 40 | 70 | 10.0 | 95 | 95 | 1000 | 1050 | 95 | 400 × 30 |
| | 26 | J | 48 | 38 | 38 | 70 | 10.0 | 92 | 95 | 1000 | 1025 | 95 | 400 × 30 |
| | 27 | K | 48 | 38 | 38 | 70 | 10.0 | 90 | 90 | 1025 | 1050 | 90 | 400 × 30 |
| | 28 | L | 48 | 38 | 38 | 70 | 8.8 | 90 | 90 | 1050 | 1080 | 90 | 500 × 60 |
| | 29 | M | 48 | 38 | 38 | 70 | 8.8 | 90 | 75 | 1050 | 1080 | 75 | 500 × 30 |

*Heat treatment means low temperature heat treatment

TABLE 4

| Classification | Material No. | Quantity of martensite (%) | plane hardness difference (Hv) | Young's modulus (kfg/mm²) | On-set stress (kgf/mm²) 0.8% | 1.0% | Anisotropic difference | Punch test work load (kfg · mm) | Fracture resistance During tensioning | During slicing |
|---|---|---|---|---|---|---|---|---|---|---|
| Example | 1 | 60 | 12 | 18,800 | 147 | 174 | 10 | 55 | ○ | ○ |
| | 2 | 54 | 10 | 17,800 | 141 | 163 | 5 | 68 | ○ | ○ |
| | 3 | 81 | 17 | 20,800 | 160 | 195 | 16 | 40 | ○ | ○ |
| | 4 | 62 | 14 | 18,700 | 146 | 174 | 14 | 50 | ○ | ○ |
| | 5 | 62 | 13 | 18,300 | 142 | 167 | 10 | 52 | ○ | ○ |
| | 6 | 61 | 9 | 18,600 | 144 | 173 | 8 | 56 | ○ | ○ |
| | 7 | 58 | 12 | 18,300 | 143 | 171 | 12 | 58 | ○ | ○ |
| | 8 | 83 | 11 | 18,500 | 145 | 170 | 4 | 37 | ○ | ○ |
| | 9 | 56 | 16 | 20,100 | 158 | 193 | 12 | 48 | ○ | ○ |
| | 10 | 61 | 17 | 20,600 | 162 | 197 | 12 | 33 | ○ | ○ |
| | 11 | 77 | 9 | 19,500 | 152 | 184 | 6 | 40 | ○ | ○ |
| | 12 | 45 | 23 | 17,600 | 138 | 163 | 18 | 35 | ○ | ○ |
| | 13 | 60 | 11 | 18,700 | 147 | 177 | 9 | 55 | ○ | ○ |
| | 14 | 59 | 15 | 18,600 | 146 | 175 | 11 | 48 | ○ | ○ |
| | 15 | 80 | 15 | 21,500 | 164 | 200 | 14 | 40 | ○ | ○ |

TABLE 5

| Classification | Material No. | Quantity of martensite (%) | plane hardness difference (Hv) | Young's modulus (kfg/mm²) | On-set stress (kgf/mm²) 0.8% | 1.0% | Anisotropic difference | Punch test work load (kfg · mm) | Fracture resistance During tensioning | During slicing |
|---|---|---|---|---|---|---|---|---|---|---|
| Comparative example | 16 | 74 | 30 | 19,700 | 150 | 180 | 18 | 22 | X | Fractured during tensioning |
| | 17 | 48 | 29 | 18,400 | 143 | 170 | 23 | 28 | X | Fractured during tensioning |
| | 18 | 38 | 10 | 16,200 | 126 | 149 | 4 | 68 | ○ | X |
| | 19 | 46 | 12 | 17,200 | 129 | 153 | 4 | 70 | ○ | X |
| | 20 | 91 | 36 | 21,000 | 159 | Immeasurable | Immeasurable | 14 | X | Fractured during tensioning |
| | 21 | 57 | 26 | 18,600 | 145 | 174 | 24 | 34 | ○ | X |
| | 22 | 60 | 28 | 17,800 | 138 | 154 | 12 | 33 | ○ | X |

TABLE 6

| Classification | Material No. | Quantity of martensite (%) | plane hardness difference (Hv) | Young's modulus (kfg/mm²) | On-set stress (kgf/mm²) 0.8% | 1.0% | Anisotropic difference | Punch test work load (kfg · mm) | Fracture resistance During tensioning | During slicing |
|---|---|---|---|---|---|---|---|---|---|---|
| Comparative example | 23 | 39 | 43 | 16,500 | 124 | 145 | 24 | 65 | X | Fractured during tensioning |
| | 24 | 61 | 26 | 19,200 | 146 | 175 | 14 | 23 | X | Fractured during tensioning |
| | 25 | 61 | 17 | 18,500 | 145 | 169 | 10 | 22 | X | Fractured during tensioning |
| | 26 | 62 | 20 | 19,000 | 146 | 174 | 10 | 18 | X | Fractured during tensioning |
| | 27 | 60 | 15 | 18,600 | 145 | 172 | 12 | 20 | X | Fractured during tensioning |
| | 28 | 62 | 54 | 17,800 | 140 | 168 | 3 | 24 | X | Fractured during tensioning |
| | 29 | 60 | 60 | 18,000 | 139 | 165 | 10 | 21 | X | Fractured during tensioning |

What is claimed is:

1. A stainless steel sheet having a high fracture resistance comprising:

non-metallic inclusions of $Al_2O_3$, MnO, and $SiO_2$ which inevitably exist in stainless steel;

the non-metallic inclusions having a composition situated in a region defined by nine points given below on terms of percentage by weight in a phase diagram of a 3-component system of "$Al_2O_3$-MnO-$SiO_2$", Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

said stainless steel sheet having an 1.0% onset stress of 1520 N/mm² (155 kgf/mm²) or more, where the 1.0% onset stress is a deformation stress when the sheet is subjected to 1.0% strain;

said stainless steel sheet having an anisotropic difference of 1.0% on-set of 196 N/mm² (20 kgf/mm²) or less, where the anisotropic difference is an absolute value of a difference of 1.0% onset stresses in a rolling direction and a crosswise direction to the rolling direction; and said stainless steel sheet having a punch test work load of at least 0.24 J (25 kgf·mm).

2. The stainless steel sheet of the claim 1, wherein said stainless steel sheet consists essentially of:

0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % soluble Al, 0.002 to 0.013 wt. % O, 0.08 to 0.9 wt. % Cu, 0.009 wt. % or less S, and the balance being Fe.

3. The stainless steel sheet of claim 2, wherein said C content is 0.032 to 0.177 wt. %.

4. The stainless steel sheet of claim 2, wherein said Si content is 0.24 to 1.90 wt. %.

5. The stainless steel sheet of claim 2, wherein said Mn content is 0.47 to 1.82 wt. %.

6. The stainless steel sheet of claim 2, wherein said Ni content is 5.20 to 8.82 wt. %.

7. The stainless steel sheet of claim 2, wherein said Cr content is 13.8 to 18.5 wt. %.

8. The stainless steel sheet of claim 2, wherein said N content is 0.013 to 0.191 wt. %.

9. The stainless steel sheet of claim 2, wherein said soluble Al content is 0.0006 to 0.0024 wt. %.

10. The stainless steel sheet of claim 2, wherein said O content is 0.0025 to 0.0124 wt. %.

11. The stainless steel sheet of claim 2, wherein said Cu content is 0.11 to 0.45 wt. %.

12. The stainless steel sheet of claim 1, wherein said nonmetallic inclusions contain 13 to 31 wt. % $Al_2O_3$, 25 to 50 wt. % MnO, and 31 to 54 wt. % $SiO_2$.

13. The stainless steel sheet of claim 1, wherein said stainless steel sheet contains 40 to 90% martensite in a thickness direction of the stainless steel sheet.

14. The stainless steel thin sheet of claim 1, wherein said 1.0% on-set stress is 1520 to 1960 $N/mm^2$ (155 to 200 $kgf/mm^2$).

15. The stainless steel sheet of claim 1, wherein said anisotropic difference of 1.0% on-set stress is 39.2 to 176.4 $N/mm^2$ (4 to 18 $kgf/mm^2$).

16. The stainless steel sheet of claim 1, wherein said punch test work load is 0.32 to 0.67 J (33 to 68 kgf·mm).

17. A method for producing a stainless steel thin sheet having high fracture resistance comprising the steps of:

preparing a stainless steel strip consisting essentially of: 0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % soluble Al, 0.002 to 0.013 wt. % O, 0.08 to 0.9 wt. % Cu, 0.009 wt. % or less S, and the balance being Fe and inevitable impurities;

said inevitable impurities existing as non-metallic inclusions having a composition situated in a region defined by nine points given below on terms of percentage by weight in a phase diagram of a 3-component system of "$Al_2O_3$-MnO-$SiO_2$", Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

applying to the stainless steel strip a process of annealing —pickling—first cold rolling ($CR_1$)—first intermediate annealing—second cold rolling ($CR_2$)—second intermediate annealing—third cold rolling ($CR_3$)—final annealing—fourth cold rolling ($CR_4$)—low temperature heat treatment;

reduction ratios of said first cold rolling, of said second cold rolling, and of said third cold rolling, each being 30% to 60%l a reduction ratio of said fourth cold rolling being 60 to 76%, and a reduction ratio per pass of the said fourth cold rolling being 3 to 15%;

annealing temperatures in said first intermediate annealing, second intermediate annealing and final annealing, each being 950° to 1150° C.;

said low temperature heat treatment being performed at a temperature of 300° to 600° C. for 0.1 sec to 300 sec.; and said final annealing and said low temperature heat treatment being performed in a non-oxidizing atmosphere containing $H_2$ of 70 vol. % or more.

18. The stainless steel sheet of claim 17, wherein said low temperature heat treatment is performed at a temperature of 400° to 500° C. for 2 to 15 sec.

* * * * *